United States Patent [19]

Smart, Jr.

[11] Patent Number: 4,552,331

[45] Date of Patent: Nov. 12, 1985

[54] REMOTELY CONTROLLABLE RESET MECHANISM FOR A VACUUM-ACTUATED SYSTEM

[75] Inventor: William A. Smart, Jr., Germantown, Wis.

[73] Assignee: Bradley Corporation, Menomonee Falls, Wis.

[21] Appl. No.: 637,296

[22] Filed: Aug. 3, 1984

[51] Int. Cl.[4] ..... F16K 31/02; F16K 35/00; F16K 37/00

[52] U.S. Cl. ..... 251/95; 4/406; 4/427; 4/DIG. 15; 116/202; 116/277; 137/554; 200/310; 251/77; 251/113; 251/129.04; 251/129.20

[58] Field of Search ..... 251/14, 67, 70, 89, 251/94, 95, 111, 113, 131, 138, 77; 137/554; 4/249, 302, 328, 406, 407, 427, 661, DIG. 15; 116/202, 277; 200/310

[56] References Cited

U.S. PATENT DOCUMENTS

| | | | |
|---|---|---|---|
| 1,045,121 | 11/1912 | Carroll | 251/67 |
| 1,644,171 | 10/1927 | Caldwell | 251/131 |
| 1,856,350 | 5/1932 | Metcalf | 251/131 |
| 2,378,404 | 6/1945 | Grant, Jr. | 137/554 |
| 2,780,433 | 2/1957 | Fleming | 251/70 |
| 4,041,557 | 8/1977 | Ringler | 4/427 |
| 4,195,662 | 4/1980 | Göttel | 116/227 |
| 4,203,173 | 5/1980 | Morris et al. | 4/427 |
| 4,498,203 | 2/1985 | Barnum et al. | 4/427 |

*Primary Examiner*—George L. Walton
*Attorney, Agent, or Firm*—Quarles & Brady

[57] ABSTRACT

A reset mechanism for a vacuum-actuated lockout device that disables a flush valve to prevent flooding of a receptacle includes a solenoid coupled to a reset stem and to a vacuum relief valve built into the reset stem. The solenoid is energized to open the relief valve in a first portion of a reset stroke and is coupled to the reset stem with a lost motion connection for withdrawal of the reset stem in a second portion of the reset stroke, after relief of the vacuum. A circuit is also disclosed for remote control of the reset mechanism.

6 Claims, 6 Drawing Figures

FIG. 1
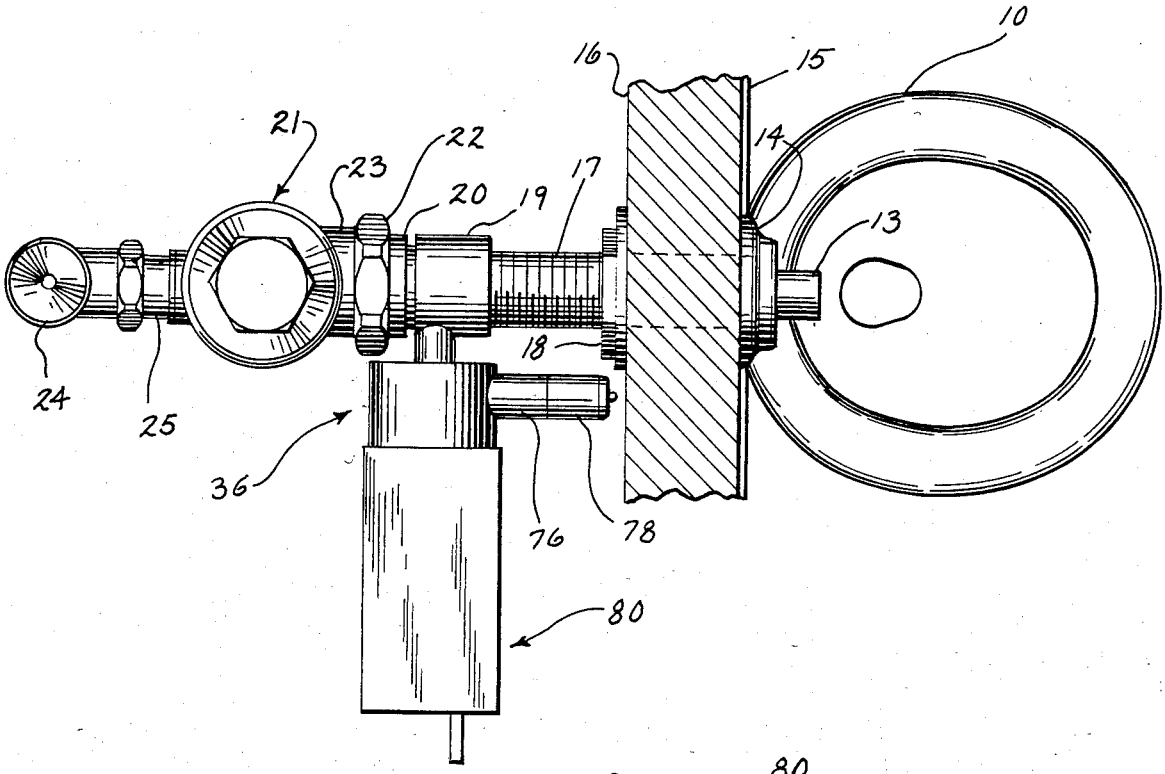
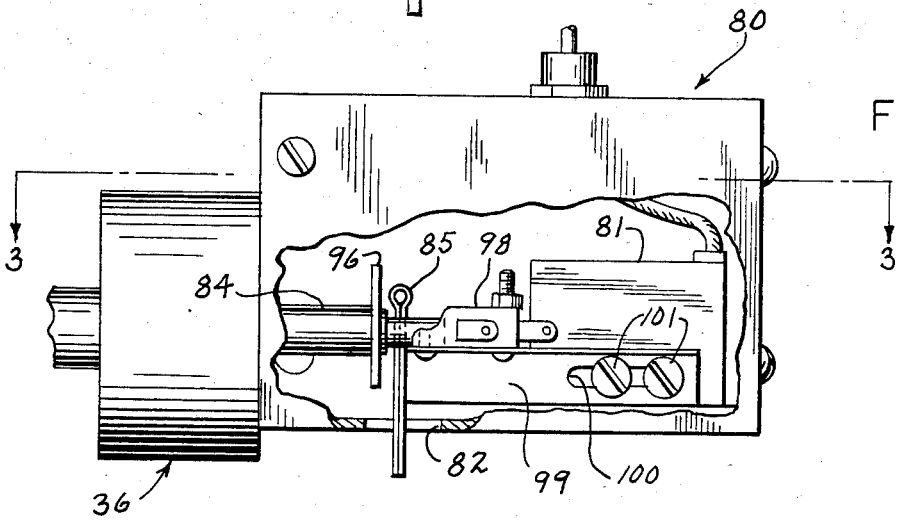
FIG. 2
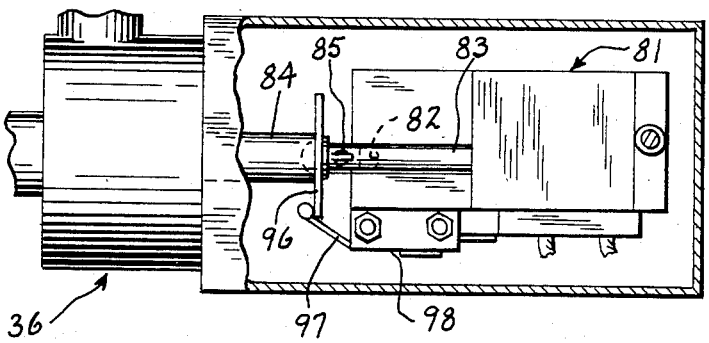
FIG. 3

REMOTELY CONTROLLABLE RESET MECHANISM FOR A VACUUM-ACTUATED SYSTEM

BACKGROUND OF THE INVENTION

The field of the invention is flow control systems, and more particularly reset mechanisms for vacuum-actuated valve shut-off devices.

A copending U.S. patent application of Barnum et al., Ser. No. 608,392, filed May 9, 1984, now U.S. Pat. No. 4,498,203, concerns a flood prevention system with a vacuum-actuated lockout mechanism for disabling a flush valve for an institutional toilet. To reset the device a relief valve knob is operated to relieve a vacuum developed during lockout, and a reset stem is pulled outward from its vacuum-actuated position. These are two separate, manual operations.

The flush valve and its associated lockout device are typically located in areas of limited accessibility, and it is therefore desirable to provide a reset mechanism for the lockout device that can be activated from a location more remote from the flush valve.

SUMMARY OF THE INVENTION

The invention resides in a mechanism that is electrically operated to relieve a vacuum developed by operation of the lockout device and to then withdraw a reset stem from its vacuum-actuated position.

The reset mechanism includes a valve situated in a passageway through the reset stem from a vacuum chamber inside the lockout device to a vacuum relief port outside the device. The reset mechanism also has a solenoid with an operating stem that is coupled to open the valve in a first portion of a reset stroke, and is also coupled with a lost motion connection to the reset stem, to engage the reset stem during a second portion of the reset stroke following relief of the vacuum.

By mechanically coupling the solenoid to the lockout device, the reset mechanism can be controlled electrically from a switch at a remote location. In a more detailed aspect of the invention, an electrical circuit is added to provide both a lockout indicator and a reset switch at a remote site.

The reset mechanism is compactly built around the manual reset stem of the prior system. It provides an adjustment for the vacuum relief valve and vacuum exhaust ports that are shielded against entry of contaminants. The reset mechanism also provides advantages in manufacuture, installation and operation of the lockout device.

These and other object and advantages of the invention will appear from the following description. In the description, reference is made to the accompanying drawings which form a part hereof and in which there is shown by way of illustration, a preferred embodiment. Such embodiment does not represent the full scope of the invention, however, as that has been reserved for the claims that follow the description.

BRIEF DESCRIPTION OF THE DRAWINGS

FIG. 1 is a top view of the plumbing system that incorporates the present invention;

FIG. 2 is a side view in elevation of a reset mechanism seen in FIG. 1;

FIG. 3 is a top view of the reset mechanism of FIG. 2 taken in the plane indicated by line 3—3 in FIG. 2;

DETAILED DESCRIPTION OF THE PREFERRED EMBODIMENT

Figure 4:
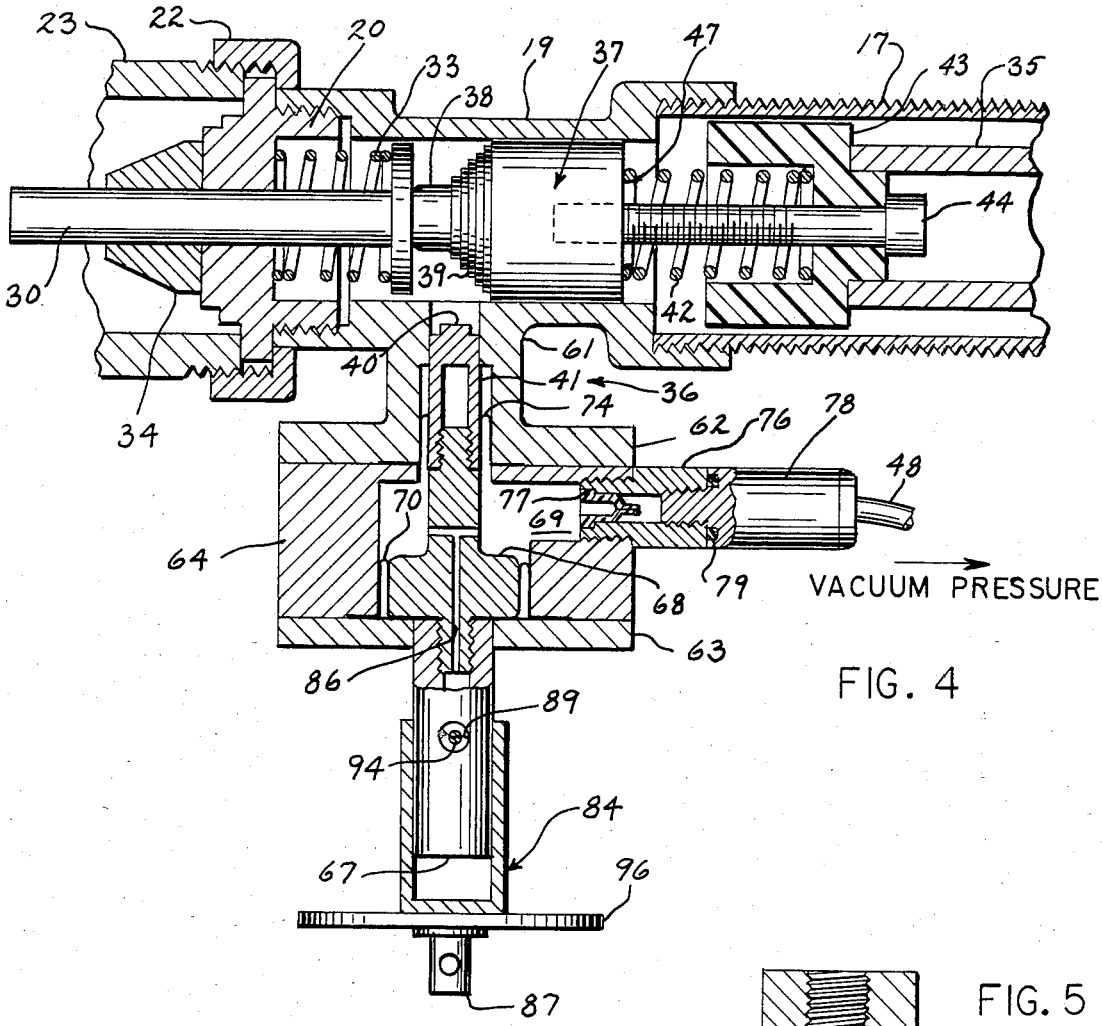
FIG. 4 is a sectional view of a vacuum-actuated fluid valve lockout device seen in FIG. 1.

FIG. 1 shows a toilet and plumbing of a type used in correctional facilities as previously disclosed in a copending U.S. patent application of Barnum et al. Ser. No. 608,392 filed May 9, 1984, now U.S. Pat. No. 4,498,203. To the extent the disclosure therein forms the background of the present invention it is hereby incorporated by reference.

A toilet bowl 10 is made of stainless steel and is attached by a back plate 15 of stainless steel to a wall 16 in a living unit. An actuator button 13 and an escutcheon plate 14 are mounted to the wall 16 above the bowl 10. A threaded sleeve 17 extends out the back side of the wall 16 through a flanged retaining nut 18. The far end of the sleeve 17 is received in one end of a sleeve extender 19. The opposite end of the sleeve extender is received in an adapter 20 mounted by nut 22 to a valve housing 23 for a flush/fill valve 21.

The toilet bowl 10 is filled from isolation valve 24 and water supply line 25. During the flush cycle, water flows through the valve 21 and additional piping (not shown) into the bowl 10. When the flush/fill control valve 21 is actuated, it will open for a predetermined time interval and then close automatically. This type of valve 21 must be allowed to reset before being operated a second time to initiate a second flush cycle. The flush-/fill control valve 21 and its timed interval of valve opening are matched with the system water pressure to supply a sufficient volume of water for flushing.

The flush/fill control valve 21 is a commercially available, off-the-shelf item. It is supplied with an associated actuator assembly and is available under the trade designation Royal 601 Valve from the Sloan Valve Company of Franklin Park, Ill.

As seen in FIG. 4, the valve 21 includes a flanged valve actuator rod 30, which extends through an opening at the center of the adapter 20. A return spring 33 encircles the actuator rod 30 and is captured between the closed end of the adapter 20 and the flange on the valve actuator rod 30. A frusto-conical seal 34 encircles the valve actuator rod 30 and abuts the interior side of the adapter 20. The adapter 20 is held in place by flanged coupling nut 22 which is slipped over the outer diameter of the adapter 20 and a threaded extending portion of the valve housing 23.

Portions of the commercially available actuator assembly seen in FIG. 4 include the outer actuator sleeve 17 and an inner actuator sleeve 35 connected to the flush actuator button 13 (FIG. 1). The inner sleeve 35 moves reciprocally within the outer, threaded actuator sleeve 17.

The sleeve extender 19 carries the elements of a lockout device 36 which has been inserted between the actuator sleeve 35 and the actuator rod 30 to disable the actuator linkage under certain conditions. The lockout mechanism 36 includes a second valve actuator rod 37 with a cylindrical post 38 which engages the flange on the valve actuator rod 30 and urges it inward upon the operation of the actuator button 13 in FIG. 1 The ratcheted rod 37 has a series of steps or rings 39 that increase in diameter in the direction of the actuator button. These steps or rings 39 are engaged by a latch button 40 integrated with the upper end of the latch tube 41. Under certain conditions, the latch button 40 is moved upward to engage one of the steps 39 on the ratcheted rod 37 to block the actuator linkage from initiating a second flush cycle.

A spring 42 has been included in the actuator linkage to protect it from impacts delivered to the actuator button 13 when it is locked. The spring 42 is stiff enough to transmit forces for actuating the flush/fill valve 21 when the ratcheted rod 37 is not engaged by the latch button 40. The spring 42 will yield, however, to heavy impacts on the button 13, when the latch button 40 has engaged the ratcheted rod 37.

A portion of the spring 42 is carried within a bore in a cylindrical spring guide 43, which in turn is carried on an elongated screw 44. The screw 45 is threaded into the back end of the ratcheted rod 37, which has an annular spring seat 47 for locating the end of the spring 42 that extends out of the spring guide 43.

The latching mechanism 40, 41 is part of a plunger assembly which also includes a piston 68 with a shaft screwed into the back end of the latch tube 41. A threaded shaft on the opposite side of the piston 68 is received in one end of a reset stem 67. The piston 68 moves up and down in a vacuum chamber 69. A first diaphragm 70 seals an annular gap between the piston 68 and a housing doughnut member 64. A second diaphragm 74 seals the chamber 69 from a space in a portion of the piston housing comprised of neck 61 and circular flange 62. The housing also includes a circular, outside cover plate 63.

There is a threaded opening through the cylindrical wall of doughnut member 64 which receives a threaded tip of a check valve housing 76. A resilient check valve diaphragm 77 is mounted in a passageway through the housing 76 to permit air to be drawn from the vacuum chamber 69 in response to a vacuum drawn through line 48 and quick disconnect fitting 78. The fitting 78 is screwed into the outer end of check valve housing 76 to trap O-ring seal 79.

As explained in the copending application Ser. No. 608,392, more fully cited above, the lockout mechanism 36 is vacuum-actuated by drawing a vacuum through line 48, which causes the plunger assembly to be drawn into the housing 61–64, and which causes the latch 40 to block movement of piston rod 37, thereby disabling the actuator linkage. In the above-cited application, the lockout mechanism 36 is reset by opening a relief valve located in the wall of the doughnut member 64 and by grasping and withdrawing the plunger assembly by its reset stem 67. Because the lockout mechanism 36 is designed for installation in a space behind, and possibly between, the walls of an institutional living unit, it would be desirable for maintenance personnel to reset the lockout from a location remote from the toilet and its associated plumbing. Such a reset mechanism is provided in a housing 80 seen in FIG. 1 which bolts onto the cylindrical housing of the lockout device 36.

As seen in FIGS. 2 and 3, the reset mechanism includes a solenoid 81 with an inwardly directed operating stem 83 that is coupled to a coupling member 84 with a cotter pin 85. As seen in more detail in FIGS. 4 and 5, the coupling member 84 includes a cylindrical head portion 87 with a radial hole and a cylindrical sleeve portion that receives the end of the reset stem 67. The solenoid operating stem 83 is cylindrical with an axial hole (not shown) for receiving the head portion 87 of the coupling member 84 and with a radial hole seen in FIG. 3 that is aligned with a hole in the head portion 87 of the coupling member 84 to receive the cotter pin 85 as seen in FIGS. 2 and 3. The cotter pin 85 extends downwardly through a slot 82 in the bottom wall of the housing to provide a manual reset mechanism that is operated with a finger similar to a gun trigger. When the solenoid 81 is energized for an electrical reset operation, it pulls its operating stem 83 into its body portion thereby exerting a force pulling on the reset stem 67.

Referring again to FIGS. 4 and 5, the reset stem 67, which formerly had but a single hole for receiving a stem on the piston 68, now has an axial passageway 88 through it from one end to the other. This axial passageway 88 is intersected by a radial passageway 89 intermediate the ends of the stem 67. An entrance into the passageway 88 at one end of the stem 67 is threaded to receive the threaded shaft on the piston 68. An entrance into the opposite end of the axial passageway 88 is threaded to receive a threaded valve adjustment plug 90. The axial passageway 88 is of larger diameter from a point just before the radial passage intersection out to its outer end. In the area before the radial passage intersection, the enlargement provides a valve seat where an O-ring 91 of resilient material forms a seal between the valve seat and an axially sliding, cylindrical valve member 92. The valve member 92 has a stem portion of reduced diameter so that a coiled return spring 93 can be trapped between a head portion of the valve member and the valve adjustment plug 90. The force provided by the spring 93 can then be adjusted by varying its length of compression through rotation of the adjustment plug 90 using the socket formed in its outer end.

Figure 5:
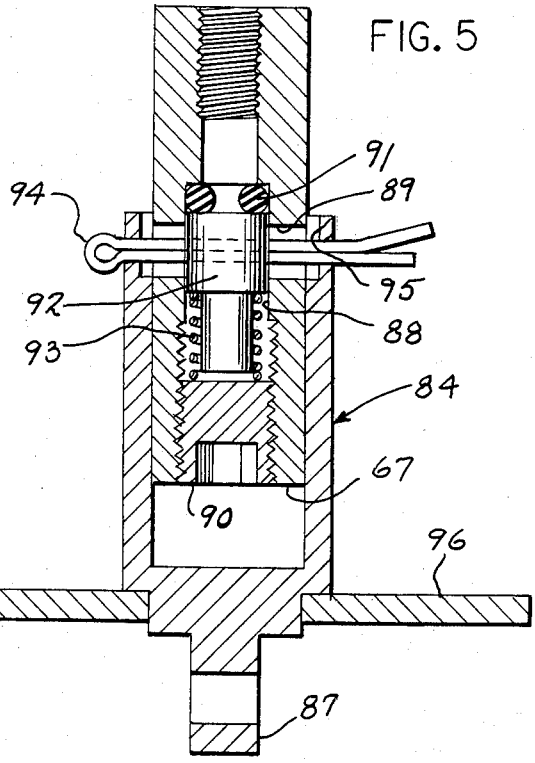
FIG. 5 is a detail section view showing the attachment of the reset mechanism at FIGS. 2 and 3 to the lockout device of FIG. 4.

As seen further in FIGS. 4 and 5, the valve member 92 has a radial hole through it which is situated in the radial passageway in the reset stem 67. A second cotter pin 94 is carried transversely by the sleeve portion of a coupling member 84, and this pin 94 couples the sleeve portion to the valve member 92. The radial passageway 89 through the reset stem 67 is wide enough in the axial direction to permit the cotter pin 94 and the valve member 92 to be withdrawn a short distance before the pin 94 engages the reset stem 67. The withdrawal of the valve member 92 opens a vacuum relief passageway 86 in FIG. 4 that extends through the piston 68 and its stem from the vacuum chamber 69, through the center of the O-ring 91 and out of the side ports formed by the opposite ends of the radial passageway 89. The sleeve portion of the coupling member 84 has a bore 95 of slightly larger diameter than the reset stem 67, and this allows communication between the ports and the outside atmosphere, while protecting the vacuum relief passageway 86 and valve components 91–93 from entry of dirt or other foreign particles.

When the solenoid 81 is energized to pull outwardly on its operating stem 83 and the reset stem 67, the cotter pin 94 is pulled back during the first portion of the solenoid stroke to open the vacuum relief valve 91, 92. When the cotter pin 94 engages the sleeve portion of the coupling member 84 on the remaining portion of the stroke, the reset stem 67 will be pulled outward to reset the valve lockout mechanism 36. Because the cotter pin 94 is moved a distance, before the reset stem 67 is moved, it provides a "lost motion" connection to the reset stem 67.

The reset stem 67 and solenoid operating stem 83 are pulled inwardly when the lockout mechanism is actuated by vacuum pressure in line 48 represented in FIG. 4. As the reset stem 67 moves inward, it carries with it an annular flange 96 seen in FIGS. 2 and 3. A portion of this flange 96 is positioned to contact and operate a movable finger 97 on a microswitch 98. The body of the microswitch 98 is mounted on a bracket 99 as seen in FIG. 2. The bracket 99 has a horizontal slot 100 through which screws 101 secure the bracket 99 to the solenoid 81.

The slot 100 permits horizontal adjustment of the bracket 99 for suitable cooperation between the flange 96 and the operating finger 97 on the microswitch 98. The flange 96 is situated between the body of the microswitch 98 and the finger 97 so that as it moves inwardly with the actuation of the lockout device 36 it will engage the finger 97 and operate the microswitch 98. The microswitch 98 is a normally open switch, and when its operating finger 97 is moved, the contacts in the microswitch will close to complete a circuit. When the flange 96 is returned to its starting position it will allow the operating finger 97 to return to its normally open position and the circuit through the microswitch 98 will be interrupted.

Figure 6:
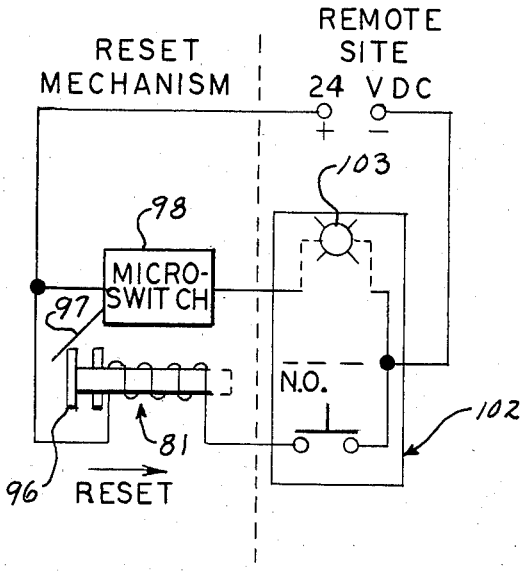
FIG. 6 is an electrical schematic diagram of a control circuit for the reset mechanism of FIGS. 2–5.

Referring next to FIG. 6, the solenoid 81, the flange 96 and the microswitch 98 are represented schematically in a circuit with an illuminated pushbutton control 102 for resetting the lockout device 36 from a remote location. The microswitch 98 is connected between the positive side of a 24-volt DC source and an input to a pilot light circuit in the illuminated pushbutton control 102. A suitable microswitch 98 is available from Cherry Electrical Products, Waukegan, Ill., under part number E22-75HX. The solenoid 81 is connected between the positive side of the DC source and an input to a pushbutton portion of the control 102. A suitable solenoid 81 is available from Deltrol Controls, Milwaukee, Wis., under part number 53717-88. The negative side of the DC source is connected to one or more ground terminals on the illuminated pushbutton control 102. This connects the microswitch 98 in the lighting circuit and the solenoid in the switching circuit of the pushbutton control 102.

When the lockout device 36 is actuated by a vacuum, the movement of the flange 96 will close the contacts of the microswitch 98 causing the illumination of a bulb 103 in the pushbutton control 102. The lighting of the bulb 102 will signal maintenance personnel that the lockout device 36 has been actuated. When the conditions causing the lockout have been removed to the satisfaction of maintenance personnel, the pushbutton can be operated to energize the solenoid 81 causing its plunger to withdraw (to the position represented in phantom in FIG. 6). This will cause the relief of the vacuum in the vacuum chamber 69 as explained in relation to FIGS. 4 and 5, and the release of the valve actuator linkage. As the solenoid stem is withdrawn it will carry the flange 96 back to its starting position to open the microswitch 98 and deenergize the pilot light 103.

From the above description, it should be apparent that a convenient mechanism has been provided for monitoring and resetting a vacuum-actuated lockout mechanism used in a flood preventer system for institutional facilities. The detailed description has been by way of example, and not by way of limitation. Therefore, to distinguish that which is essential to the invention from that which has been described by way of example only, the following claims are made.

I claim:

1. A reset mechanism for a fluid-valve assembly with a lockout device of the type having a reciprocally movable reset stem that moves in a vacuum-actuated stroke when a partial vacuum is drawn in a vacuum chamber of the lockout device to lock an actuator for the fluid-valve assembly, the reset mechanism comprising:

the reset stem having a passageway extending from the vacuum chamber to a port outside a lockout device housing;

valve means in the passageway biased to a position closing the passageway; and a solenoid with an operating stem coupled to the valve means, and coupled to the reset stem with a lost motion connection, the solenoid being energized to move its operating stem and the reset stem on a reset stroke opposite in direction from the vacuum-actuated stroke, wherein the valve means is opened in a first portion of the reset stroke to relieve the vacuum in the vacuum chamber during a lost motion movement through the lost motion connection, and wherein the reset stem is moved in a second portion of the reset stroke following the lost motion movement to withdraw the reset stem from a vacuum-actuated position to unlock the actuator of the fluid-valve assembly.

2. The reset mechanism of claim 1, wherein:

the valve means includes means in the passageway forming a valve seat, and also includes a valve member biased for movement against the valve seat; and wherein the reset stem has openings communicating with the valve member; and wherein the lost motion connection is provided by means extending through the openings in the reset stem to couple the valve member to the solenoid operating stem, this means being movable a distance within the openings before engaging the reset stem.

3. The reset mechanism of claim 2, wherein the solenoid operating stem is coupled to the means providing the lost motion connection through sleeve means around a portion of the reset stem, and wherein the means providing the lost motion connection is a pin carried transversely through the reset stem and the sleeve means.

4. The reset mechanism of claim 2, wherein the valve member is spring-biased.

5. The reset mechanism of claim 2, further comprising an O-ring seal positioned between the valve seat and the valve member.

6. The reset mechanism of claim 1, further comprising:

an electrical control having a switch portion and a bulb portion in parallel to the switch portion, the switch portion being connected in series with the solenoid to control energizing of the solenoid for the reset stroke; and a switch connected in series with the bulb portion of the electrical control to control energizing of the bulb portion, the switch closing in response to movement of the solenoid operating stem in the vacuum-actuated stroke for energizing the bulb portion and the switch opening in response to movement of the solenoid operating stem on the reset stroke for deenergizing the bulb portion.

* * * * *